US006866921B2

(12) United States Patent
Grab et al.

(10) Patent No.: US 6,866,921 B2
(45) Date of Patent: Mar. 15, 2005

(54) CHROMIUM-CONTAINING CEMENTED CARBIDE BODY HAVING A SURFACE ZONE OF BINDER ENRICHMENT

(75) Inventors: George P. Grab, Greensburg, PA (US); Mark S. Greenfield, Greensburg, PA (US); Anakkavur T. Santhanam, Monroeville, PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 10/383,792

(22) Filed: Mar. 7, 2003

(65) Prior Publication Data

US 2003/0161695 A1 Aug. 28, 2003

Related U.S. Application Data

(63) Continuation of application No. 09/638,048, filed on Aug. 11, 2000, now Pat. No. 6,554,548.

(51) Int. Cl.[7] ..... B32B 9/00

(52) U.S. Cl. ..... 428/212; 428/332; 428/212; 428/469; 428/472; 428/312.2; 428/312.8; 428/315.5; 428/697; 428/698; 428/699; 428/701; 428/702; 407/119; 51/307; 51/309

(58) Field of Search ..... 428/472, 212, 428/332, 312.2, 312.8, 315.5, 469, 698, 701, 702, 697, 699, 336; 51/307, 309; 407/119

(56) References Cited

U.S. PATENT DOCUMENTS

| | | | |
|---|---|---|---|
| 3,785,801 A | 1/1974 | Benjamin | 75/0.5 BC |
| 4,168,957 A | 9/1979 | Lee et al. | 51/309 |
| 4,277,283 A | 7/1981 | Tobioka et al. | 75/238 |
| 4,587,174 A | 5/1986 | Yoshimura et al. | 428/552 |
| 4,610,931 A | 9/1986 | Nemeth et al. | 428/547 |
| 4,828,612 A | 5/1989 | Yohe | 75/238 |
| 4,830,930 A | 5/1989 | Taniguchi et al. | 428/547 |

(List continued on next page.)

FOREIGN PATENT DOCUMENTS

| | | |
|---|---|---|
| DE | 4000223 | 7/1993 |
| EP | 0685572 | 12/1995 |
| EP | 0792390 | 9/1997 |
| EP | 1038989 | 9/2000 |
| JP | 5487719 | 12/1979 |
| JP | 55120936 | 9/1980 |
| JP | 6330220 | 11/1994 |
| JP | 09207008 | 12/1997 |
| JP | 11197936 | 1/1998 |
| JP | 11300516 | 4/1998 |
| JP | 10219384 | 8/1998 |
| JP | 11021651 | 1/1999 |
| JP | 11061317 | 3/1999 |
| JP | 11221708 | 8/1999 |

OTHER PUBLICATIONS

US 5,143,488, 9/1992, Santhanam et al. (withdrawn)

PCT International Application No. PCT/US01/21170–International Search Report of Apr. 5, 2002.

PCT International Application No. PCT/US01/21166–International Search Report of Apr. 5, 2002.

English Abstract of JP6212341A, Sintered Hard Alloy and Its Production (Jan. 1994).

English Abstract of JP7216492A, Hard Material and its Production (Aug., 1995).

(List continued on next page.)

*Primary Examiner*—Archene Turner
(74) *Attorney, Agent, or Firm*—John J. Prizzi

(57) ABSTRACT

A coated cemented (binder alloy, e.g., cobalt-chromium alloy) tungsten carbide cutting insert that comprises a substrate and a coating. The substrate contains at least about 70 weight percent tungsten and carbon, between about 3 weight percent and about 12 weight percent cobalt, and at least 0.09 weight percent chromium. The substrate presents a surface zone of binder alloy enrichment that begins near (or at) and extends inwardly from a peripheral surface of the substrate. The coating includes a base layer that contains chromium.

40 Claims, 2 Drawing Sheets

U.S. PATENT DOCUMENTS

| | | | | |
|---|---|---|---|---|
| 4,913,877 | A | 4/1990 | Yohe | 419/13 |
| 5,162,147 | A | 11/1992 | Ruppi | 428/216 |
| 5,181,953 | A | 1/1993 | Nakano et al. | 75/237 |
| RE34,180 | E | 2/1993 | Nemeth et al. | 428/547 |
| 5,188,489 | A | 2/1993 | Santhanam et al. | 407/119 |
| 5,232,318 | A | 8/1993 | Santhanam et al. | 407/119 |
| 5,283,030 | A | 2/1994 | Nakano et al. | 419/53 |
| 5,288,676 | A | 2/1994 | Shimada et al. | 501/93 |
| 5,305,840 | A | 4/1994 | Liang et al. | 175/426 |
| 5,310,605 | A | 5/1994 | Baldoni, II et al. | 428/569 |
| 5,325,747 | A | 7/1994 | Santhanam et al. | 82/1.11 |
| 5,364,209 | A | 11/1994 | Santhanam et al. | 407/119 |
| 5,484,468 | A | 1/1996 | Ostlund et al. | 75/236 |
| 5,597,272 | A | 1/1997 | Moriguchi et al. | 407/119 |
| 5,619,000 | A | 4/1997 | Ederyd et al. | 75/240 |
| 5,665,431 | A | 9/1997 | Narasimhan | 427/255 |
| 5,694,639 | A | 12/1997 | Oskarsson et al. | 419/16 |
| 5,700,551 | A | 12/1997 | Kukino et al. | 428/212 |
| 5,722,803 | A | 3/1998 | Battaglia et al. | 407/119 |
| 5,729,823 | A | 3/1998 | Gustafson et al. | 428/552 |
| 5,750,247 | A | 5/1998 | Bryant et al. | 428/323 |
| 5,776,588 | A | 7/1998 | Moriguchi et al. | 428/210 |
| 5,841,045 | A | 11/1998 | McCandlish et al. | 75/236 |
| 5,920,760 | A | 7/1999 | Yoshimura et al. | 428/551 |
| 5,942,318 | A | 8/1999 | Söderberg et al. | 428/216 |
| 5,955,186 | A | 9/1999 | Grab | 428/312.8 |
| 5,976,707 | A | 11/1999 | Grab et al. | 428/547 |
| 5,984,593 | A | 11/1999 | Bryant | 407/119 |
| 6,017,488 | A | 1/2000 | Weinl et al. | 419/26 |
| 6,022,175 | A | 2/2000 | Heinrich et al. | 407/119 |
| 6,250,855 | B1 | 6/2001 | Persson et al. | 407/119 |

OTHER PUBLICATIONS

English Abstract of JP11221708A, Cemented–Carbide Miniature Drill with Excellent Abrasion Resistance (Aug. 1999).

English Abstract of JP9295205A, Throw Away Insert Made of Coated Cemented Carbide and Manufacture Thereof (Nov. 1997).

English Abstract of JP5329703A, Surface Coated Cemented Carbide Cutting Tool (Dec. 1993).

Henjered et al., "Quantative microanalysis of carbide/carbide interfaces in WC–Co base cemented carbides", Materials Science and Technology vol. 2 (Aug. 1986) pp. 847–855.

Santhanam et al., An Advanced Cobalt–enriched Grade Designed to Enhance Machining Productivity, ASM's Int'l Conf on High Productivity Machining, Materials and Processing, New Orleans, LA 1985 Paper No. 8503–003 pp. 1–8.

ASTM Designation No. B276–91(Reapproved 1996), Standard Test Method for Apparent Porosity in Cemented Carbides (1996), pp. 1–6.

Kennametal Lab Report K3567 on Iscar IC656 and unknown Sumitomo Tools (Jul., 1985).

Kennametal Lab Report on Kustom Machine & Tool Grade IT–110 (Jun,. 2000).

Summary of Kennametal Lab Report on Bohlerit Grade R421 (Mar., 1989).

Summary of Kennametal Lab Report on Carolina Coatings Grade BC–1 (Apr., 1992).

Summary of Kennametal Lab Report on Mitsubishi Grade UC5005 (Dec., 1998).

Summary of Kennametal Lab Report on North American Carbide NS326 (Apr., 1999).

Summary of Kennametal Lab Report on North American Carbide NS675 (Jul., 1994).

Kennametal Lab Report R4307 on North American Carbide NS675 (Jul., 1994).

Summary of Kennametal Lab Report on Plansee Grade TCC10 (Jan., 1996).

Summary of Kennametal Lab Report on Sumitomo, Igetaloy Grade AC 230 (Jul., 1997–Nov., 1996).

Summary of Kennametal Lab Report on Sumitomo, Igetaloy Grade AC 304 (Nov., 1998).

Summary of Kennametal Lab Report on Sumitomo, Igetaloy Grade K153R2 (Feb., 1997).

Summary of Kennametal Lab Report on Toshiba Grade TD915 (Oct., 1998).

Kennametal Lab Report R4656 on Toshiba–Tungaloy Grade TD915 (Oct., 1998).

Summary of Kennametal Lab Report on Toshiba Grade T841 (Jul., 1992).

Summary of Kennametal Lab Report on Teledyne Firth Sterling Grade KM21 (Apr., 1994).

Summary of Kennametal Lab Report on Valenite W6–S7 (Jul., 1999).

International Search Report PCT Patent Application US 01/21156 (mailed Dec. 3, 2002).

CHROMIUM-CONTAINING CEMENTED CARBIDE BODY HAVING A SURFACE ZONE OF BINDER ENRICHMENT

CROSS REFERENCE TO RELATED APPLICATION

This application is a continuation of U.S. patent application Ser. No. 09/638,048, filed Aug. 11, 2000, now U.S. Pat. No. 6,554,548.

FIELD OF THE INVENTION

The invention pertains to a chromium-containing cemented carbide body (e.g., a coated cemented (cobalt-chromium binder alloy) tungsten carbide cutting insert) that has a surface zone of binder alloy enrichment.

BACKGROUND OF THE INVENTION

Coated cemented carbide (e.g., cemented [cobalt] tungsten carbide) cutting inserts that exhibit a surface zone of binder enrichment are in use for metal cutting applications. The surface zone of binder enrichment may be stratified such as shown in the article "The Microstructural Features and Cutting Performance of the High Edge Strength Kennametal Grade KC850", Proceedings of the Tenth Plansee Seminar, Reutte, Trol, Austria, Metalwerke Plansee A. G. (1981), pp. 613–627. The surface zone of binder enrichment may be non-stratified such as shown in U.S. Reissue Pat. No. 34,180 to Nemeth et al. or U.S. Pat. No. 5,955,186 to Grab.

Current coated cemented carbide cutting inserts that exhibit a surface zone of binder enrichment have acceptable performance characteristics. However, it would still be desirable to provide a coated cemented carbide cutting insert that has improved performance characteristics.

SUMMARY OF THE INVENTION

In one form thereof, the invention is a cutting insert having a tungsten carbide based bulk composition of at least 70 weight percent tungsten and carbon, between about 3 weight percent and about 12 weight percent cobalt, and at least 0.09 weight percent chromium. The cobalt and chromium form a binder alloy. The binder alloy content of the composition is enriched in a surface zone beginning near and extending inwardly from the peripheral surface of the substrate.

The substrate also preferably contains nitrogen as a result of the mechanism used to obtain binder enrichment.

Preferably, the tungsten carbide based bulk composition has up to about 10 weight percent tantalum, up to about 6 weight percent niobium, and up to about 10 weight percent titanium.

Preferably, there is at least one weight percent total of tantalum, niobium, and titanium, and more preferably, at least two weight percent total of tantalum, niobium, and titanium.

Preferably, the ratio of the weight percent of chromium to the weight percent of cobalt ranges between about 0.03 to about 0.15, and more preferably, between about 0.05 to 0.10.

Preferably, the ratio of the weight percent of chromium to the weight percent cobalt remains about constant between the surface zone of binder alloy enrichment and the bulk composition.

Preferably, the cutting insert in accordance with the invention has a substrate composition as described above and a hard coating thereon composed of one or more layers.

Preferably, the innermost layer contains chromium, which has diffused into the layer from the substrate during chemical vapor deposition of the coating onto the substrate, preferably forming a chromium containing solid solution layer (e.g., a titanium chromium carbonitride, or a titanium tungsten chromium carbonitride).

These and other aspects of the invention will become more clear upon review of the following detailed description of the invention in conjunction with the drawings.

BRIEF DESCRIPTION OF THE DRAWINGS

The following is a brief description of the drawings that form a part of this patent application.

DETAILED DESCRIPTION OF THE INVENTION

Figure 1:
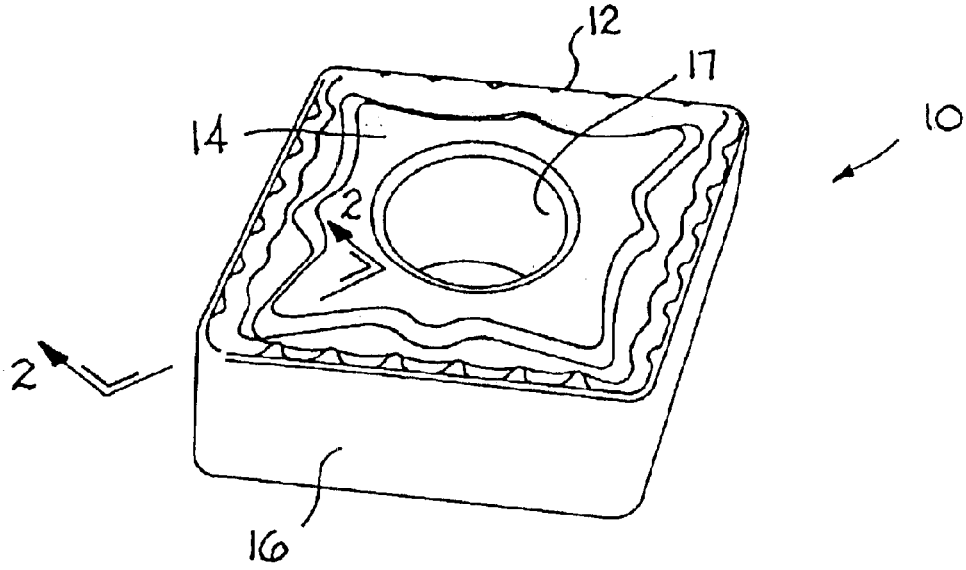
FIG. 1 is an isometric view of a specific embodiment of a cutting insert.
Figure 2:
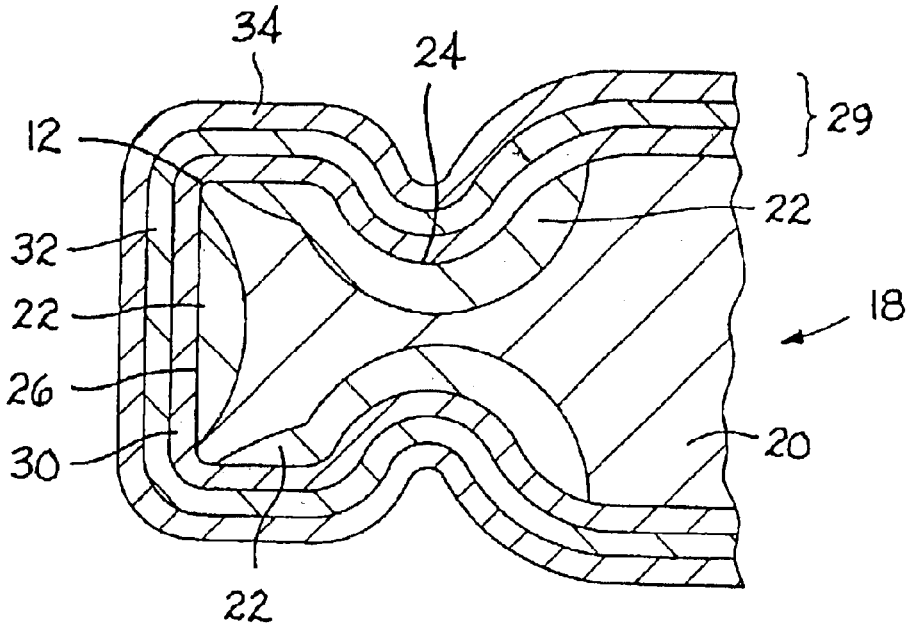
FIG. 2 is a cross-sectional view of the cutting insert of FIG. 1 taken along section line 2—2 showing a coating scheme that has three layers and a substrate that has a surface zone of binder enrichment that extends inwardly from both the rake surface and the flank surface.

Referring to the drawings, FIGS. 1 and 2 show a CNMG style coated cutting insert generally designated as 10. Coated cutting insert 10 presents a cutting edge 12 at the juncture of a rake face 14 and a flank face 16. Cutting insert 10 contains a hole 17.

The coated cutting insert 10 further includes a substrate generally designated as 18 (se FIG. 2). The substrate 18 has a bulk region 20 and a surface zone of binder alloy enrichment 22 that has a maximum binder alloy content greater than the binder alloy content in the bulk region 20 of the substrate. The substrate 18 has a rake surface 24 and a flank surface 26. In this specific embodiment, the surface zone of binder alloy enrichment 22 extends inwardly from both the rake surface 24 and the flank surface 26 of the substrate 18 near the cutting edge 12. The surface zone of binder alloy enrichment is removed from the other areas of the cutting insert by grinding.

The substrate 18 comprises a cemented carbide material. One exemplary substrate is a cemented (cobalt-chromium binder alloy) tungsten carbide that contains one or more carbide forming elements such as, for example, titanium, tantalum, niobium, zirconium, and hafnium. The material may also contain vanadium, but the vanadium must be present along with one or more of the above-identified carbide-forming elements; namely, titanium, tantalum, niobium, zirconium, and hafnium. The substrate also contains chromium wherein most, if not all, of the chromium is alloyed with the cobalt to form a cobalt-chromium binder alloy. Other elements may optionally be a component of the binder alloy wherein these elements include tungsten, iron, nickel, ruthenium, and rhenium. In some instances, up to 20 weight percent of the binder alloy may comprise tungsten.

In the case of a cemented (cobalt-chromium binder alloy) tungsten carbide, the surface zone of binder alloy enrichment typically exhibits a non-stratified type of binder alloy enrichment. The porosity of the bulk substrate is typically Type A to Type B porosity according to ASTM Designation B276-91 (Reapproved 1996). Applicants consider that the scope of this invention also encompasses a substrate with a surface zone of non-stratified binder alloy enrichment wherein the bulk substrate has a Type C porosity according to ASTM Designation B276-91 (Reapproved 1996). U.S. Reissue Pat. No. 34,180 to Nemeth et al. discloses cemented tungsten carbide cutting inserts that exhibit the non-stratified type of binder enrichment. Pending U.S. patent application Ser. No. 09/534,710 filed on Mar. 24, 2000 and entitled Cemented Carbide Tool and Method of Making to Liu et al. discloses a substrate with a porosity rating according to ASTM Designation B276-91 (Reapproved 1996) of greater than C00, and a surface zone of non-stratified binder enrichment.

In addition, applicants consider that the scope of the invention encompasses a substrate with a surface zone of stratified binder alloy enrichment. The typical substrate with a surface zone of stratified binder alloy enrichment has a bulk substrate with a Type C porosity according to ASTM Designation B276-91 (Reapproved 1996). An example of a substrate with a Type C porosity and a surface zone of stratified binder alloy enrichment is in the above-mentioned article entitled "The Microstructural Features and Cutting Performance of the High Edge Strength Kennametal Grade KC850". However, applicants still contemplate that the scope of the invention may encompass a substrate with a surface zone of stratified binder enrichment that has a bulk substrate with Type A and/or Type B porosity according to ASTM Designation B276-91 (Reapproved 1996). The article to Kobori et al. entitled "Binder Enriched Layer Formed Near the Surface of Cemented Carbide", Funtai Oyobi Funtai Yakin, Vol. 34, No. 1, pages 129–132 (1987), describes the stratified type of binder enrichment.

A range for the components of an exemplary substrate made of cemented (cobalt-chromium binder alloy) tungsten carbide, i.e., a tungsten carbide-based material, comprises between about 3 weight percent to about 12 weight percent cobalt, up to about 10 weight percent tantalum, up to about 6 weight percent niobium, up to about 10 weight percent titanium, greater than about 70 weight percent tungsten and carbon, and a minimum of 0.09 weight percent of chromium. The upper limit on chromium content is determined by the level at which the substrate can still avoid toughness problems associated with the specific application in question. The preferably upper limit for chromium is about 15 percent of the cobalt content (e.g., 1.8 w/o chromium at 12 w/o cobalt; 0.45 w/o chromium at 3 w/o cobalt) or more preferably, 10 percent of the cobalt content (e.g., 1.2 w/o at 12 w/o cobalt; and 0.3 w/o chromium at 3 w/o cobalt). Preferably, the lower limit of chromium content is also dependent on cobalt content and should be at least 3 percent of the cobalt content (e.g., 0.09 w/o chromium at 3 w/o cobalt; and 0.36 w/o chromium at 12 w/o cobalt, and more preferably, at least 5 percent of the cobalt content (e.g., 0.15 w/o chromium at 3 w/o cobalt, and 0.6 w/o chromium at 12 w/o cobalt).

Another range for the components for an exemplary substrate made of cemented (cobalt-chromium binder alloy) tungsten carbide comprises between about 5 and about 6 weight percent cobalt, between about 3 and about 4 weight percent tantalum, between about 1 and about 2.5 weight percent titanium, between about 0.2 and about 0.6 weight percent niobium, chromium present in an amount between about 0.2 weight percent and about 0.4 weight, and at least about 70 weight percent tungsten and carbon.

Applicants contemplate that in an exemplary substrate the surface zone of binder alloy enrichment may extend inwardly from the peripheral surface of the substrate to a depth of up to about 50 micrometers. In another exemplary substrate, the range for the depth of binder alloy enrichment is between about 20 and about 30 micrometers.

In one exemplary substrate, the maximum binder alloy content in the surface zone of binder alloy enrichment ranges between about 125 and about 300 weight percent of the binder content in the bulk substrate. In another exemplary substrate, the maximum binder alloy content in the surface zone of binder alloy enrichment ranges between about 150 weight percent and about 300 weight percent of the binder alloy content in the bulk substrate. In still another exemplary substrate, the maximum binder alloy content in the surface zone of binder alloy enrichment ranges between about 200 and about 300 weight percent of the binder alloy content in the bulk substrate. In yet another exemplary substrate the binder alloy content in the surface zone of binder alloy enrichment ranges between about 150 and about 250 percent of the binder alloy content in the bulk substrate.

In one exemplary substrate that comprises cemented (cobalt-chromium binder alloy) tungsten carbide, a specific range for the physical properties is a hardness of between about 89 and about 93 Rockwell A, a coercive force ($H_C$) of between about 115 and about 350 oersteds, and a magnetic saturation between about 128 [162 micro Tesla cubic meter per kilogram cobalt ($\mu$T-m$^3$/kg)] and about 160 gauss cubic centimeter per gram cobalt (gauss-cm$^3$/gm) [202 micro Tesla cubic meter per kilogram cobalt ($\mu$T-m$^3$/kg)]. In another exemplary substrate that comprises cemented (cobalt) tungsten carbide, a specific range for the physical properties is a bulk hardness of between about 91.5 and about 92.5 Rockwell A, a coercive force ($H_C$) of between about 155 and about 195 oersteds, and a magnetic saturation between about 128 gauss cubic centimeter [162 micro Tesla cubic meter per kilogram cobalt ($\mu$T-m$^3$/kg)] and about 160 gauss cubic centimeter per gram cobalt (gauss-cm$^3$/gm) [202 micro Tesla cubic meter per kilogram cobalt ($\mu$T-m$^3$/kg)].

As shown in FIGS. 1 and 2, the cutting insert 10 has a coating scheme, generally designated by brackets 29, that is adherently bonded to the substrate. The coating scheme 29 includes a base layer 30 next to the substrate 18, a mediate layer 32 next to the base layer 30, and an outer layer 34 next to the mediate layer 32. Although this specific embodiment illustrates three layers, applicants contemplate that the coating scheme may comprise one or more layers.

As exemplary coating materials the base layer may comprise one or more materials selected from the group consisting of one or more of the carbides, nitrides, carbonitrides and oxides of titanium.

The intermediate layer may comprise one or more materials selected from the group consisting of titanium carbonitride, titanium nitride, titanium carbide, alumina, titanium aluminum nitride, zirconium nitride, zirconium carbide, hafnium nitride, and hafnium carbide.

The outer layer may comprise one or more materials selected from the group consisting of titanium carbonitride, titanium nitride, titanium carbide, alumina, titanium aluminum nitride, titanium diboride, chromium nitride, hafnium nitride, and hafnium carbide.

Generally speaking, one or more of the coating layers of the coating schemes are applied by chemical vapor deposition (CVD) and moderate temperature chemical vapor deposition (MTCVD). However, applicants also contemplate that one or more layers of a coating scheme may be applied by physical vapor deposition (PVD).

The substrate may contain a layer eta phase between the base coating layer and the substrate. The layer of eta phase is no thicker than between about 2 micrometers to about 3 micrometers.

A cutting insert typically used in turning applications generally presents a surface zone of binder alloy enrichment that extends inwardly from both the rake surface and the flank surface of the substrate. Such is the case for the cutting insert illustrated in FIGS. 1 and 2 wherein, as mentioned hereinabove, FIG. 2 shows that the surface zone of binder alloy enrichment extends inwardly from both the rake surface and the flank surface of the substrate.

There are, however, certain cutting inserts used for certain applications in which the surface zone of binder alloy enrichment extends inwardly only from the rake surface of the substrate and any binder alloy enrichment is absent from the other surfaces of the substrate. In these styles of cutting inserts, the flank surface of the sintered substrate is typically ground to remove the surface zone of binder alloy enrichment that extends from the flank surface so as to leave the surface zone of binder alloy enrichment that extends from the rake surface.

Figure 3:
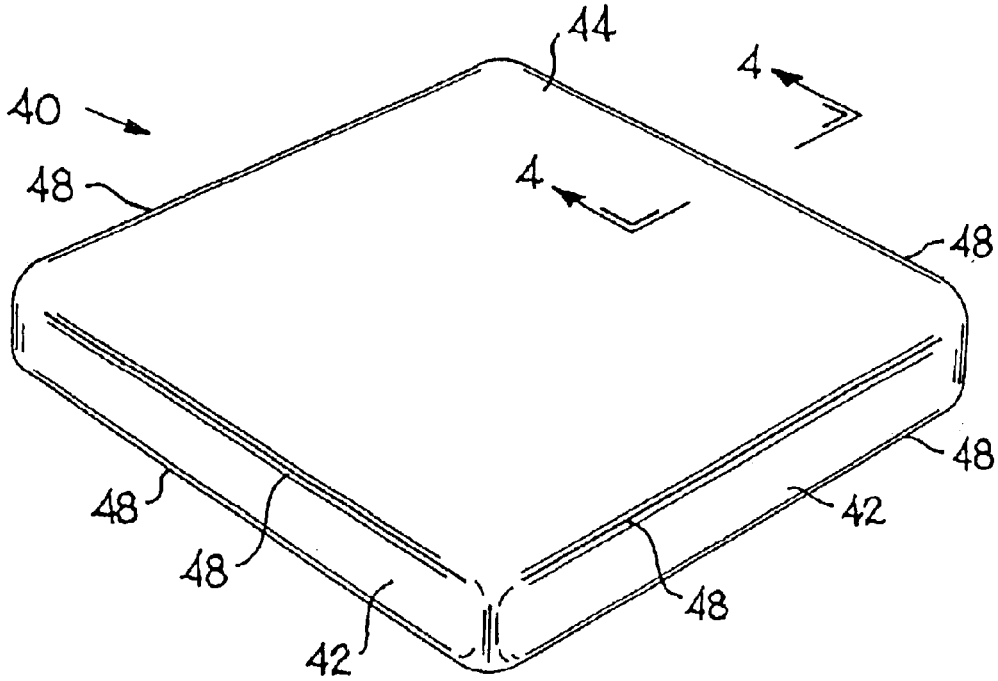
FIG. 3 is an isometric view of another specific embodiment of a cutting insert.
Figure 4:
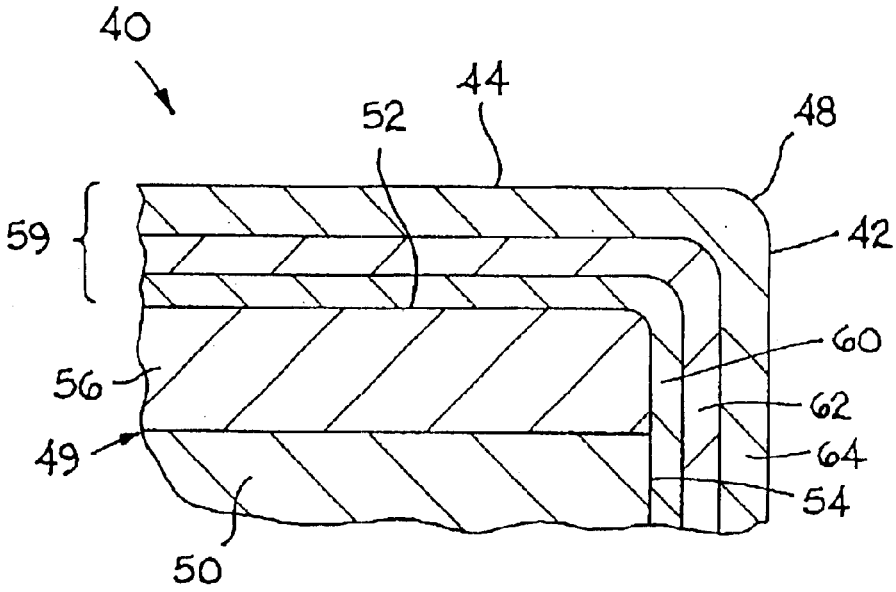
FIG. 4 is a cross-sectional view of the cutting insert of FIG. 3 take along section 3—3 showing a coating scheme that has three layers and a substrate that has a surface zone of binder enrichment extending inwardly only from the rake surface.

FIGS. 3 and 4 show a SNG style of coated cutting insert 40 that has a microstructure in which the surface zone of binder alloy enrichment is present only under the rake surface. In this regard, cutting insert 40 has four flank faces 42 that intersect with opposite rake faces 44 to from eight cutting edges 48.

Cutting insert 40 has substrate generally designated as 49 (see FIG. 4) with a peripheral rake surface 52 and a peripheral flank surface 54. The substrate 49 has a bulk region 50 that comprises a majority of the substrate 49, and a surface zone of binder alloy enrichment 56 extends inwardly from the peripheral rake surface 52. Any surface zone of binder alloy enrichment is absent from the substrate 49 near the peripheral flank surfaces. Typically, the surface zone of binder alloy enrichment is removed by grinding from the flank surfaces.

The substrate 49 of cutting insert 40 may be essentially the same composition and present the same level of binder enrichment as the substrate 18 of cutting insert 10. Cutting insert 40 has a coating scheme shown in brackets 59 that may be the same as the coating scheme 29 of cutting insert 10. In this regard, coating scheme 59 presents a base layer 60, a mediate layer 62 on the base layer 60, and an outer layer 64 on the mediate layer 62. Additional description of the substrate 49 and the coating scheme 59 is not necessary.

Coated cutting inserts comprising Substrate No. 1 (as described hereinafter) and the coating scheme described as follows were subjected to an analysis via transmission electron microscopy (TEM). This coating scheme comprised: a base layer of titanium nitride applied to the substrate by CVD to a thickness of 0.5 micrometers, a first mediate layer of titanium carbonitride applied by MTCVD to the base layer to a thickness of 4 micrometers, a second mediate layer of alumina applied to the first mediate layer by CVD to a thickness of 1.5 micrometers, and an outer layer of titanium nitride applied to the second mediate layer by CVD to a thickness of 0.5 micrometers.

This TEM analysis revealed that the ratio of the weight percent chromium to the weight percent of cobalt (wt % chromium/wt % cobalt) was uniform between the surface zone of cobalt enrichment and the bulk substrate. The composition of the cobalt or binder alloy phase in the surface zone of enrichment was equal to 4.5 weight percent chromium and 95.5 weight percent cobalt (or 5 atomic percent chromium and 95 atomic percent cobalt). Since the weight percent ratio of the starting chromium and cobalt contents was 0.3 to 5.75, which is about 5 percent, it appeared that most, if not all, of the chromium was in the cobalt binder. Applicants would also expect that some tungsten would be in the binder alloy so that up to 20 weight percent of the binder alloy may comprise tungsten.

Even though the base layer comprises titanium nitride or titanium carbonitride, due to the higher temperature (i.e., 900 to 1000 degrees Centigrade) at which the base layer is applied, there is believed to be some diffusion of carbon from the substrate into the base layer so that the titanium nitride changes to titanium carbonitride or the carbon content of the titanium carbonitride increases. It was surprisingly discovered that some of the chromium in the substrate diffused into the base layer so that the base layer is believed to comprise a solid solution titanium-chromium carbonitride, or a solid solution titanium-tungsten-chromium carbonitride.

A TEM thin foil was analyzed for chemistry via a Philips CM200 Field Emission Gun TEM, using the EMi SPEC interface to the EDS system. The results of this analysis for the metals in the base coating layer is shown below:

| | w/o | a/o |
|---|---|---|
| Ti | 86.48 | 93.29 |
| Cr | 1.91 | 1.90 |
| Co | 2.60 | 2.28 |
| W | 9.0 | 2.53 |

Applicants believe that the diffusion of chromium into the base layer of the coating scheme improves the adhesion of the coating to the substrate and the wear resistance of the coating so as to improve the performance of the cutting insert. TEM analysis of the base coating layer adjacent to the substrate found that the ratio of the chromium to the cobalt in the base coating layer was about 1.9/2.3 on an atomic percent basis with chromium being present in the base layer at about 1.9 atomic percent. This is surprisingly a significantly higher chromium/cobalt ratio (0.83) than found in the substrate (approximately 0.05). The inventors believe that to maximize enhanced adhesion and wear resistance, the ratio of the Cr/Co ratio in the coating to the Cr/Co ratio in the substrate should preferably be greater than 5, more preferably, greater than 10, and most preferably, greater than 15.

Coated cutting inserts were made and tested in turning tests and slotted bar tests. Set forth below is a description of these cutting inserts and the test results.

Table 1 below presents the composition in weight percent of the elements that comprise the substrates. In the starting powder mixtures to make Substrates Nos. 1 and 2 nitrogen is present in the form of titanium nitride. In the starting powder mixture to make Substrates Nos. 3 and 4 nitrogen is present in the form of titanium carbonitride wherein the carbon to nitrogen ratio is 1:1. For the starting powder mixtures to make each one of the Substrates Nos. 1 through 4, the chromium is present in the form of chromium carbide.

TABLE 1

Starting Composition (Weight Percent) of Substrates

| Substrate | Cobalt | Tantalum | Titanium | Niobium | Chromium | Tungsten, Carbon & Nitrogen |
|---|---|---|---|---|---|---|
| No. 1 | 5.75 | 3.3 | 1.80 | 0.40 | 0.30 | 88.45 |
| No. 2 | 5.75 | 3.3 | 1.80 | 0.40 | None | 88.75 |
| No. 3 | 5.75 | 3.3 | 1.80 | 0.40 | None | 88.75 |
| No. 4 | 5.75 | 3.3 | 1.80 | 0.40 | 0.30 | 88.45 |

The above substrates were prepared by conventional powder metallurgical sintering techniques including ball milling, pressing the powders into a green compact (i.e., a consolidated mass of the starting powders), delubing (or dewaxing) the green compact, and vacuum sintering. For these substrates, the vacuum sintering occurred at a temperature of about 2700 degrees Fahrenheit (1482 degrees Centigrade) for a duration of about 45 to about 90 minutes. Table 2 below sets forth some of the physical properties of the sintered substrates.

TABLE 2

Physical Properties of Sintered Substrates

| Substrate | Coercive Force $H_C$ (Oe) | MS (gauss $cm^3$/gr Co) | Thickness of CEZ ($\mu$m) | Hardness ($R_A$) | Porosity |
|---|---|---|---|---|---|
| No. 1 | 179 | 131 | 31 | 91.6 | A02-B00-C00 |
| No. 2 | 163 | 137 | 20 | 91.2 | A02-B00-C00 |
| No. 3 | 160 | 140 | 41 | 91.9 | A02-B00-C00 |
| No. 4 | 165 | 143 | 40 | 92.2 | A02-B00-C00 |

Table 2 presents the coercive force ($H_C$) in oersteds (Oe), the magnetic saturation (MS) in gauss cubic centimeter per gram cobalt, the thickness of the surface zone of binder (cobalt) enrichment (CEZ) in micrometers, the hardness in Rockwell A of the bulk of the substrate, and the porosity of the bulk substrate as measured by ASTM Designation B 276-91 (Reapproved 1996) entitled "Standard Test Method for Apparent Porosity in Cemented Carbides".

Substrates Nos. 1 and 2 were ground top and bottom and honed, and then were coated with the following coating scheme (Coating Scheme A): a base layer of titanium nitride applied by chemical vapor deposition (CVD) to a thickness of 0.5 micrometers, a first mediate layer of titanium carbonitride applied to the base layer by moderate temperature chemical vapor deposition (MTCVD) to a thickness of 3.5 micrometers, a second mediate layer of titanium carbonitride applied to the first mediate layer by CVD to a thickness of 0.5 micrometers, a third mediate layer of alumina (kappa phase) applied to the second mediate layer by CVD to a thickness of 2.0 micrometers, and an outer layer of titanium nitride applied by CVD to the third mediate layer to a thickness of 0.5 micrometers.

Table 3 below sets forth the results in tool life as measured in minutes of four repetitions of turning tests under the following parameters: a speed equal to 590 surface feet per minute [180 surface meters per minute], a feed equal to 0.010 inches per revolution (ipr) [0.25 millimeters per revolution], a depth of cut equal to 0.080 inches (2 millimeters), and flood coolant. The workpiece material was a 316Ti stainless steel bar (German DIN 1.4571). The style of the cutting insert was CNMG432 with a 6 degree positive rake.

TABLE 3

Turning (316Ti Stainless Steel) Test Tool Life Results

| Example (Substrate/Coating) [Presence of Cr] | Test 1 | Test 2 | Test 3 | Test 4 | Average [minutes] |
|---|---|---|---|---|---|
| No. 1/A [Cr] | 11.7 | 46.6 | 33.1 | 31.9 | 30.8 |
| No. 2/A [no Cr] | 12.0 | 21.9 | — | — | 17.0 |

The failure mode for each one of the cutting inserts used in the turning tests reported in Table 3 was depth of cut notching. The tool life criteria for the turning test tool life results presented in Table 3 were: uniform flank wear equal to 0.015 inches (0.38 millimeters); maximum flank wear equal to 0.030 inches (0.76 millimeters); nose wear equal to 0.03 inches (0.76 millimeters); depth of cut notching equal to 0.020 inches (0.51 millimeters); crater wear equal to 0.004 inches (0.10 millimeters); and trailing edge wear equal to 0.030 inches (0.76 millimeters).

Substrates Nos. 3 and 4 were coating according to the following scheme (Coating Scheme B): a base layer of titanium nitride applied to the substrate by CVD to a thickness of 0.5 micrometers, a first mediate layer of titanium carbonitride applied to the base layer by MTCVD to a thickness of 3.5 micrometers, a second mediate layer of titanium carbonitride applied to the first mediate layer by CVD to a thickness of 0.5 micrometers, a third mediate layer of alumina (kappa phase) applied to the second mediate layer by CVD to a thickness of 2.5 micrometers, and an outer layer of titanium nitride applied by CVD to the third mediate layer to a thickness of 0.5 micrometers. As described above, because of the temperature (i.e., 900 to 1000 degrees Centigrade) at which the base layer was applied, applicants expect that carbon and chromium each diffused into the base layer of the coating scheme so that the base layer comprised a titanium-chromium solid solution carbonitride where the carbon and chromium contributions were from the substrate.

Table 4 below sets forth the test results in tool life as measured in minutes of a slotted bar test done at the following parameters: a speed equal to 500 surface feet per minute (sfm) [152 surface meters per minute], a feed equal to 0.006 inches per revolution (ipr) [1.5 millimeters per revolution], and a depth of cut equal to 0.100 inches [2.5 millimeters], and flood coolant. The workpiece material was a 304 stainless steel bar (German DIN 1.4301). The style of the cutting insert was CNMG432 with a 6 degree positive rake.

TABLE 4

Tool Life [in minutes] from Slotted Bar Tests

| Example [Substrate/Coating] | Test 1 | Test 2 | Test 3 | Test 4 | Test 5 | Average [minutes] |
|---|---|---|---|---|---|---|
| No. 3/B [no Cr] | 0.7 | 1 | 2.8 | 2.6 | 0.6 | 1.5 |
| No. 4/B [Cr] | 3.7 | 2.7 | 1.4 | 4.2 | 2.6 | 2.9 |

The slotted bar had two diametrically opposed 0.75 inch maximum (1.91 centimeters) radial slots on a six inch diameter bar. For each one of the cutting inserts used in the slotted bar test results reported in Table 4, the failure mode was chipping or fracture of the cutting insert.

Substrates Nos. 3 and 4 were coated according to the following coating scheme (Coating Scheme C): a base layer of titanium carbonitride was applied to the substrate by CVD to a thickness of 2 micrometers, a mediate layer of titanium carbide was applied to the base layer by CVD to a thickness of 4 micrometers, and an outer layer of alumina was applied to the mediate layer by CVD to a thickness of 1.5 micrometers. These coated cutting inserts were then tested in the turning of 316Ti stainless steel under the following operating parameters: a speed equal to 590 sfm [180 smm], a feed equal to 0.010 ipr [0.25 mmpr], and a depth of cut equal to 0.080 inches [2.0 mm]. Table 5 sets forth the test results as tool life measured in minutes. The style of the cutting insert was CNMG432 with a 6 degree positive rake.

TABLE 5

Tool Life (minutes) of Coated Substrates TC1342 and TC1343

| Example [Substrate/Coating] | Test 1 | Test 2 | Test 3 | Average [minutes] |
|---|---|---|---|---|
| No. 3/C [no Cr] | 14 | 8 | 11 | 11 |
| No. 4/C [Cr] | 24 | 14 | 14 | 17.3 |

The failure mode for each one of the cutting inserts used in the turning tests reported in Table 5 was depth of cut notching. The tool life criteria for the turning test tool life results presented in Table 5 were: uniform flank wear equal to 0.015 inches (0.38 millimeters); maximum flank wear equal to 0.030 inches (0.76 millimeters); nose wear equal to 0.03 inches (0.76 millimeters); depth of cut notching equal to 0.020 inches (0.51 millimeters); crater wear equal to 0.004 inches (0.10 millimeters); and trailing edge wear equal to 0.030 inches (0.76 millimeters).

Cutting inserts (Style CNMG432 with a 6 degree positive rake) were also tested by a slotted bar test under the following parameters: a speed equal to 500 surface feet per minute (sfm) [152 surface meters per minute], a feed equal to 0.006 inches per revolution (ipr) [0.15 millimeters per revolution], and a depth of cut equal to 0.100 inches [2.5 millimeters], and in which the workpiece material was 304 stainless steel. Table 6 presents the test results as tool life measured in minutes.

TABLE 6

Slotted Bar Test Results of Coated Cutting Inserts

| Example [Substrate/Coating] | Test 1 | Test 2 | Test 3 | Test 4 | Test 5 | Average [minutes] |
|---|---|---|---|---|---|---|
| No. 3/C [no Cr] | 2 | 4 | 2 | 3 | 4 | 3.0 |
| No. 4/C [Cr] | 4 | 4 | 3 | 6 | 6 | 4.6 |

For each one of the cutting inserts used in the slotted bar test results reported in Table 6, the failure mode was breakage of the cutting insert.

These test results show that for the overall turning of 316Ti stainless steel, the coated cutting inserts that had chromium in the substrate thereof had 181 percent longer tool life and a 157 percent longer tool life. More specifically, for the coated cutting inserts having the A coating scheme [Substrates Nos. 1 and 2], the cutting insert with the substrate containing chromium had 181 percent longer tool life than the cutting insert with the substrate that did not contain chromium. For the coated cutting inserts having the C coating scheme [Substrates Nos. 3 and 4], the cutting insert with the substrate containing chromium had 157 percent longer tool life than the cutting insert with the substrate that did not contain chromium.

These test results also show that for the slotted bar test, the coated cutting inserts that had chromium in the substrate thereof had 193 percent longer tool life and a 153 percent longer tool. More specifically, for the coated cutting inserts having the B coating scheme [Substrates Nos. 3 and 4], the cutting insert with the substrate containing chromium had 193 percent longer tool life than the cutting insert with the substrate that did not contain chromium. For the coated cutting inserts having the C coating scheme [Substrates Nos. 3 and 4], the cutting insert with the substrate containing chromium had 153 percent longer tool life than the cutting insert with the substrate that did not contain chromium.

Applicants believe that the improvement in the performance by the cutting inserts that contain chromium is due to the better adhesion of the coating to the substrate. Applicants believe that the better adhesion is principally due to the diffusion of the chromium into the base layer during the coating process. The presence of the chromium in the base layer is consistent with the improvement in the depth of cut notching.

All patents and documents identified in this patent application are hereby incorporated by reference herein.

Other embodiments of the invention will be apparent to those skilled in the art from a consideration of the specification or practice of the invention disclosed herein. Applicants intend that the specification and the examples are only illustrative, and that the claims define the true scope and spirit of the invention.

What is claimed is:

1. A coated cutting insert comprising:

a rake face and a flank face, a cutting edge at the juncture of the rake face and the flank face;

the cutting insert having a hard refractory coating and a substrate wherein the coating is adherently bonded to the substrate;

the substrate comprising a tungsten carbide-based material comprising a bulk composition of at least about 70 weight percent tungsten and carbon, between about 3 weight percent and about 12 weight percent cobalt, and greater than 0.1 weight percent chromium wherein the ratio of the weight percent of the chromium to the cobalt ranges between about 0.03 and about 0.15;

the cobalt and essentially all of the chromium and some of the tungsten forming a binder alloy and wherein the binder alloy consisting essentially of cobalt and chromium and tungsten; and wherein the binder alloy content being enriched in a surface zone of binder alloy enrichment beginning near and extending inwardly from a peripheral surface of the substrate.

2. The coated cutting insert of claim 1 wherein the bulk composition of the substrate further comprises between about 5 and about 6 weight percent cobalt, between about 3 and about 4 weight percent tantalum, between about 1 and about 2.5 titanium, between about 0.2 and about 0.6 niobium.

3. The coated cutting insert of claim 1 wherein the bulk composition of the substrate comprises about 5.7 weight percent cobalt, about 3.3 weight percent tantalum, about 1.8 weight percent titanium, about 0.4 weight percent niobium, about 0.3 weight percent chromium, and about 88.5 weight percent tungsten and carbon.

4. The coated cutting insert of claim 1 wherein the ratio of the weight percent of chromium to the weight percent of the cobalt remains constant between the surface zone of enrichment and the bulk substrate.

5. The coated cutting insert of claim 1 wherein the surface zone of binder alloy enrichment has a maximum binder alloy content between about 125 and about 300 percent of the binder alloy content in the bulk substrate.

6. The coated cutting insert of claim 1 wherein the surface zone of binder alloy enrichment has a maximum binder alloy content between about 200 and about 300 percent of the binder alloy content in the bulk substrate.

7. The coated cutting insert of claim 1 wherein the surface zone of binder alloy enrichment extends to a depth up to about 50 micrometers from the peripheral surface of the substrate.

8. The coated cutting insert of claim 1 wherein the surface zone of binder alloy enrichment exhibits a non-stratified type of enrichment.

9. The coated cutting insert of claim 8 wherein the bulk substrate contains pores up to 10 micrometers as so to exhibit an apparent porosity of Type A according to ASTM Designation B276-91 (Reapproved 1996).

10. The coated cutting insert of claim 8 wherein the bulk substrate contains pores in the range from 10 micrometers to 25 micrometers as so to exhibit an apparent porosity of Type B according to ASTM Designation B276-91 (Reapproved 1996).

11. The coated cutting insert of claim 8 wherein the bulk substrate contains uncombined carbon as so to exhibit an apparent porosity of Type C according to ASTM Designation B276-91 (Reapproved 1996).

12. The coated cutting insert of claim 1 wherein the surface zone of binder alloy enrichment exhibits a stratified type of enrichment.

13. The coated cutting insert of claim 12 wherein the bulk substrate contains pores up to 10 micrometers as so to exhibit an apparent porosity of Type A according to ASTM Designation B276-91 (Reapproved 1996).

14. The coated cutting insert of claim 12 wherein the bulk substrate contains pores in the range from 10 micrometers to 25 micrometers as so to exhibit an apparent porosity of Type B according to ASTM Designation B276-91 (Reapproved 1996).

15. The coated cutting insert of claim 12 wherein the bulk substrate contains uncombined carbon as so to exhibit an apparent porosity of Type C according to ASTM Designation B276-91 (Reapproved 1996).

16. The coated cutting insert of claim 1 wherein the coating includes a base layer next to the substrate, and the base layer contains chromium.

17. The coated cutting insert of claim 16 wherein the chromium in the base layer is diffused from the substrate during the application of the coating.

18. The coated cutting insert of claim 16 wherein the coating further including another layer applied to the surface of the base layer.

19. The coated cutting insert of claim 16 wherein the components of the base layer applied to the substrate comprise titanium and nitrogen.

20. The coated cutting insert of claim 19 wherein the base layer includes a solid solution containing titanium, chromium and nitrogen.

21. The coated cutting insert of claim 20 wherein the base layer further includes carbon, and the base layer including a solid solution of titanium, chromium, carbon and nitrogen.

22. The coated cutting insert of claim 21 wherein the carbon in the base layer is diffused from the substrate during application of the coating.

23. The coated cutting insert of claim 20 wherein the components of the base layer applied to the substrate further comprise carbon.

24. The coated cutting insert of claim 1 wherein the bulk substrate having a hardness of between about 89 and about 93 Rockwell A, a coercive force ($H_C$) of between about 115 and about 350 oersteds, and a magnetic saturation between about 128 and about 160 gauss cubic centimeter per gram cobalt.

25. The coated cutting insert of claim 1 wherein the ratio of the weight percent of the chromium to the cobalt ranges between about 0.05 to about 0.10.

26. A coated cutting insert comprising:

a rake face and a flank face, a cutting edge at the juncture of the rake face and the flank face;

the cutting insert having a hard refractory coating and a substrate wherein the coating is adherently bonded to the substrate;

the substrate comprising a tungsten carbide-based material comprising a bulk composition of at least about 70 weight percent tungsten and carbon, between about 3 weight percent and about 12 weight percent cobalt, and greater than 0.1 weight percent chromium wherein the ratio of the weight percent of the chromium to the cobalt ranges between about 0.03 and about 0.15;

the cobalt and essentially all of the chromium and some of the tungsten forming a binder alloy wherein the binder alloy consisting essentially of cobalt and chromium and tungsten;

wherein the binder alloy content being enriched in a surface zone of binder alloy enrichment beginning near and extending inwardly from a peripheral surface of the substrate; and the coating comprising a base layer applied to the surface of the substrate, and the base layer containing chromium.

27. The coated cutting insert of claim 26 wherein the chromium in the base layer is diffused from the substrate during the application of the coating.

28. The coated cutting insert of claim 26 wherein the components of the base layer applied to the substrate comprise titanium and nitrogen.

29. The coated cutting insert of claim 28 wherein the base layer including a solid solution containing titanium, chromium and nitrogen.

30. The coated cutting insert of claim 29 wherein the base layer further contains carbon diffused from the substrate during the application of the coating, and the base layer contains a solid solution of titanium, chromium, nitrogen and carbon.

31. The coated cutting insert of claim 28 wherein the components of the base layer further include carbon, and the base layer contains a solid solution of titanium, chromium, nitrogen and carbon.

32. The coated cutting insert of claim 26 wherein the base layer comprises titanium and one or more elements selected from the group consisting of carbon, nitrogen and oxygen.

33. The coated cutting insert of claim 26 wherein the coating further includes a mediate layer applied to the base layer, and the mediate layer selected from the group consisting of titanium carbonitride, titanium nitride, titanium carbide, alumina, titanium aluminum nitride, hafnium carbide, hafnium nitride, zirconium carbide, and zirconium nitride.

34. The coated cutting insert of claim 33 wherein the coating further includes an outer layer, and the outer layer comprises one or more materials selected from the group consisting of titanium carbonitride, titanium nitride, titanium carbide, alumina, titanium aluminum nitride, titanium diboride, chromium nitride, hafnium nitride, and hafnium carbide.

35. The coated cutting insert of claim 26 wherein the coating comprises one or more layers applied by one or more of physical vapor deposition, chemical vapor deposition and moderate temperature chemical vapor deposition.

36. The coated cutting insert of claim 26 wherein the base layer comprising titanium nitride and chromium wherein the titanium nitride being applied to the substrate by chemical vapor deposition, and the coating further including a first layer of titanium carbonitride applied to the base layer by moderate temperature chemical vapor deposition, a second mediate layer of titanium carbonitride applied to the first mediate layer by chemical vapor deposition, a third mediate layer of alumina applied to the second mediate layer by chemical vapor deposition, and an outer layer of titanium nitride applied to the third mediate layer by chemical vapor deposition.

37. The coated cutting insert of claim 26 wherein the base layer comprising titanium carbonitride and chromium wherein the titanium carbonitride being applied to the substrate by chemical vapor deposition, and the coating further including a mediate layer of titanium carbide applied to the base layer by chemical vapor deposition, and an outer layer of alumina applied to the mediate layer by chemical vapor deposition.

38. The coated cutting insert of claim 26 wherein the base layer comprising titanium carbonitride and chromium wherein the titanium carbonitride being applied to the substrate by chemical vapor deposition, and the coating further including a first mediate layer of titanium carbonitride applied to the base layer by moderate temperature chemical vapor deposition, a second mediate layer of alumina applied to the first mediate layer by chemical vapor deposition, and an outer layer of titanium nitride applied to the second mediate layer by chemical vapor deposition.

39. The coated cutting insert of claim 26 wherein the ratio of the weight percent of chromium to the weight percent of the binder alloy remains constant between the surface zone of enrichment and the bulk substrate.

40. The coated cutting insert of claim 26 wherein the ratio of the weight percent of the chromium to the cobalt ranges between about 0.05 to about 0.10.

* * * * *